US008393708B2

(12) United States Patent
Ito

(10) Patent No.: US 8,393,708 B2
(45) Date of Patent: Mar. 12, 2013

(54) RECORDING DEVICE, METHOD OF POSITIONING RECORDING HEAD, AND METHOD OF MANUFACTURING RECORDING DEVICE

(75) Inventor: Seiko Ito, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 572 days.

(21) Appl. No.: 12/625,979

(22) Filed: Nov. 25, 2009

(65) Prior Publication Data

US 2010/0128081 A1 May 27, 2010

(30) Foreign Application Priority Data

Nov. 25, 2008 (JP) ..... 2008-298983

(51) Int. Cl.
*B41J 29/393* (2006.01)
*B41J 2/015* (2006.01)

(52) U.S. Cl. ..... 347/19; 347/20

(58) Field of Classification Search ..... 347/9, 19–20
See application file for complete search history.

(56) References Cited

U.S. PATENT DOCUMENTS 6,575,557 B2 * 6/2003 Tominaga ..... 347/37
2008/0291251 A1 * 11/2008 Hattori ..... 347/86

FOREIGN PATENT DOCUMENTS

JP 2003-154724 A 5/2003
JP 2004-216816 A 8/2004
JP 2006-212791 A 8/2006

* cited by examiner

*Primary Examiner* — Jason Uhlenhake
(74) *Attorney, Agent, or Firm* — Baker Botts L.L.P.

(57) ABSTRACT

A recording device may comprise a recording head comprising a discharge port configured to discharge a liquid droplet. The recording device may also comprise a head supporting member. The recording device may yet further comprise a securing member configured to secure the recording head to the head supporting member such that a positional relationship between the head supporting member and the recording head is changeable in a direction intersecting a liquid droplet discharging direction. The recording device may yet further comprise a light emitter, and a light receiver configured to receive the light from the light emitter. The recording device may yet further comprise a position detector configured to detect the positional relationship on the basis of an intensity of the light received by the light receiver. The recording device may yet further comprise an outputting unit configured to output a signal of the positional relationship.

17 Claims, 9 Drawing Sheets

RECORDING DEVICE, METHOD OF POSITIONING RECORDING HEAD, AND METHOD OF MANUFACTURING RECORDING DEVICE

CROSS REFERENCE TO RELATED APPLICATION

This application claims priority to Japanese Patent Application No. 2008-298983, filed Nov. 25, 2008, the entire subject matter and disclosure of which is incorporated herein by reference.

BACKGROUND OF THE DISCLOSURE

1. Field of the Disclosure

The features herein relate to a recording device including a recording head that discharges liquid droplets, a method of positioning the recording head, and a method of manufacturing the recording device.

2. Description of the Related Art

As a method of positioning a recording head that discharges liquid droplets, a method of adjusting the position of a recording head while confirming the position of a nozzle that discharges the liquid droplets using an optical microscope is known.

SUMMARY OF THE INVENTION

Although, it has been assumed that a recording head is positioned when a recording device is manufactured, it has not been assumed that the position of a recording head is adjusted by a user when a recording device is being used. In addition, when a recording head is removed for, for example, performing maintenance when the recording device is used, it is difficult for the user to position the recording head while confirming the position of a nozzle with an optical microscope.

A need has arisen for providing a recording device that allows a user to adjust the position of a recording head, a method of positioning the recording head, and a method of manufacturing the recording device.

According to one embodiment herein, a recording device may comprise a recording head comprising a discharge port that is configured to discharge a liquid droplet. The recording device may also comprise a head supporting member that is configured to support the recording head. The recording device may yet further comprise a securing member that is configured to secure the recording head to the head supporting member such that a positional relationship between the head supporting member and the recording head is changeable in a direction intersecting a liquid droplet discharging direction. The recording device may yet further comprise a light emitter that is configured to emit a light. The recording device may yet further comprise a light receiver that is configured to receive the light from the light emitter. The recording device may yet further comprise a position detector that is configured to detect the positional relationship on the basis of an intensity of the light received by the light receiver. The recording device may yet further comprise an outputting unit that is configured to output a signal of the positional relationship detected by the position detector.

DESCRIPTION OF THE EMBODIMENTS

Various embodiments, and their features and advantages, may be understood by referring to FIGS. 1-9, like numerals being used for corresponding parts in the various drawings.

Figure 1:
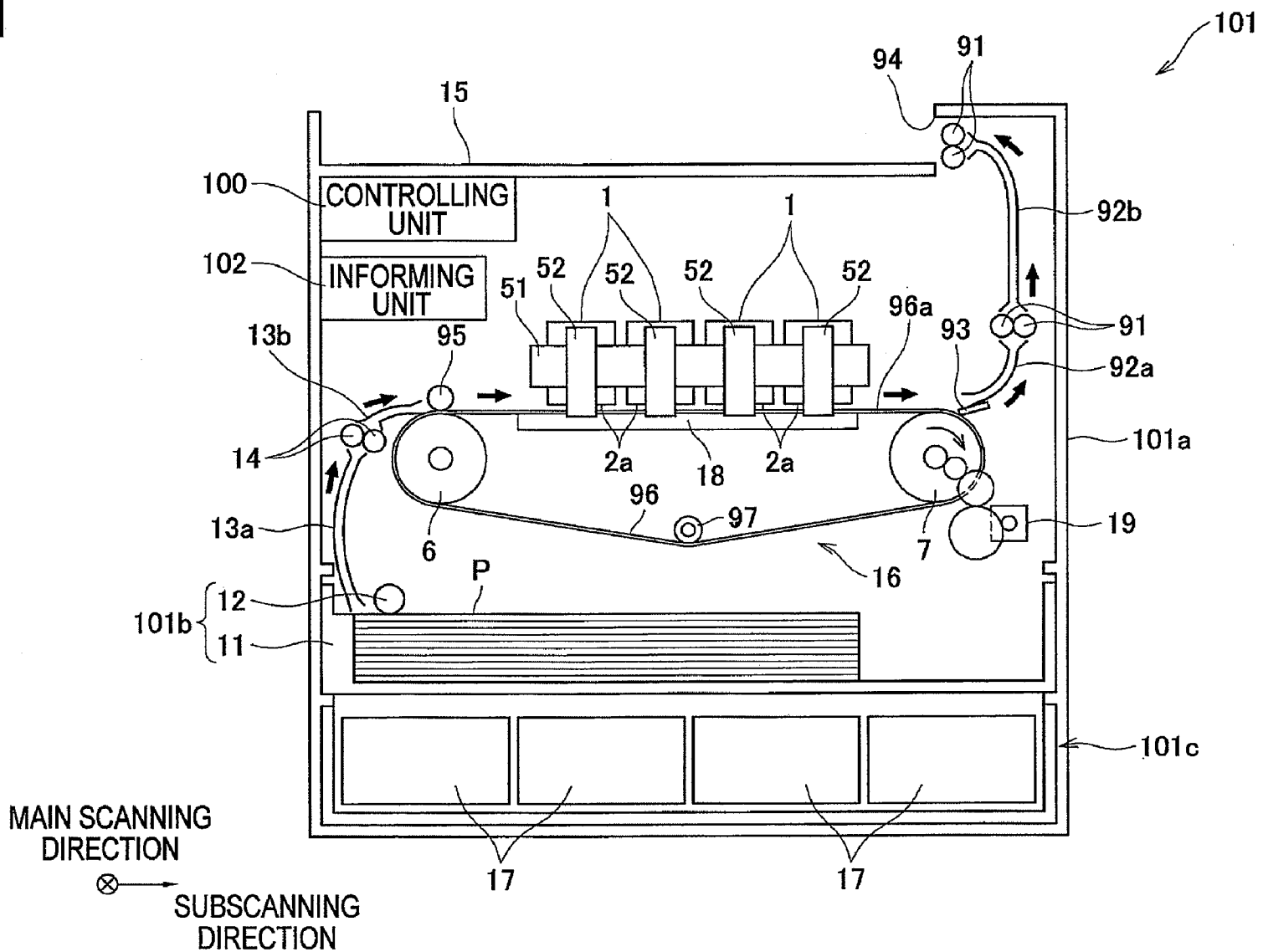
FIG. 1 is a vertical sectional view of an internal structure of an inkjet printer according to an embodiment of the present invention.

Referring to FIG. 1, an inkjet printer 101 has a rectangular parallelepiped housing 101*a*. A plurality of, e.g., four, inkjet heads 1 (which may discharge magenta ink, cyan ink, yellow ink, and black ink, respectively) and a conveying mechanism 16 are disposed in the housing 101*a*. A controlling unit 100 that controls the operations of the inkjet heads 1 and the conveying mechanism 16 is mounted to an inner surface of a top plate of the housing 101*a*. An informing unit 102 for informing a user of a mounting state of each inkjet head 1 is provided in the housing 101*a*. By turning on a lamp, the informing unit 102 informs, for example, a user that the inkjet heads 1 are precisely disposed at predetermined mounting positions.

A sheet-feed unit 101*b* that is removable from the housing 101*a* is disposed below the conveying mechanism 16. An ink tank unit 101*c* that is removable from the housing 101*a* is disposed beneath the sheet-feed unit 101*b*. The ink tank unit 101*c* includes a plurality of, e.g., four, ink tanks 17 that store inks having different colors.

A sheet conveying path along which sheets P are conveyed along thick arrows shown in FIG. 1 is formed in the inkjet printer 101 so as to extend from the sheet-feed unit 101*b* towards a recessed portion 15, which is a sheet-discharge portion. The sheet-feed unit 101*b* includes a sheet-feed tray 11 and a sheet-feed roller 12. The sheet-feed tray 11 has the shape of a box that is open towards the upper side, and holds the sheets P in a stacked state. The sheet-feed roller 12 sends out the topmost sheet P on the sheet-feed tray 11. The sent out sheet P is conveyed to the conveying mechanism 16 while being guided by guides 13*a* and 13*b*, and being nipped by a roller pair 14.

The conveying mechanism 16 includes a plurality of, e.g., two, belt rollers 6 and 7, a conveying belt 96, a tension roller 97, and a platen 18. The conveying belt 96 is an endless belt wound between the rollers 6 and 7. At a lower side of a loop of the conveying belt 96, the tension roller 97 is urged downward while contacting an inner peripheral surface of the conveying belt 96, such that a tension is applied to the conveying belt 96. The platen 18 is disposed in an area surrounded by the conveying belt 96. At a position of the platen 18 opposing each inkjet head 1, the conveying belt 96 is supported so as not to be flexed downward. The belt roller 7 is a drive roller. By applying driving power to a shaft of the belt roller 7 from a conveying motor 19, the belt roller 7 rotates clockwise in FIG. 1. The belt roller 6 is a driven roller. By moving the conveying belt 96 by rotating the belt roller 7, the belt roller 6 rotates clockwise in FIG. 1. The driving power of the conveying motor 19 is transmitted to the belt roller 7 through a plurality of gears.

An outer peripheral surface 96*a* of the conveying belt 96 is made adhesive by being siliconized. A nip roller 95 is disposed at a position opposing the belt roller 6. The nip roller 95 pushes a sheet P sent out from the sheet-feed unit 101*b* against the outer peripheral surface 96*a* of the conveying belt 96. The sheet P pushed against the outer peripheral surface 96*a* is conveyed in a sheet conveying direction (corresponding to a subscanning direction, which is a rightward direction in FIG. 1) while being held on the outer peripheral surface 96*a* by its adhesive power.

A separating plate 93 is provided at a position opposing the belt roller 7. The separating plate 93 separates the sheet P from the outer peripheral surface 96*a*. The separated sheet P is conveyed while being guided by guides 92*a* and 92*b* and being nipped by two feed roller pairs 91. Then, the sheet P is discharged from a discharge port 94, which is formed at the top portion of the housing 101*a*, to the recessed portion 15, which is a sheet-discharge portion provided at the upper surface of the housing 101*a*.

The plurality of, e.g., four, inkjet heads 1 discharge inks having different colors (e.g., magenta, yellow, cyan, and black). Each of the plurality of inkjet heads 1 has a substantially parallelepiped shape that is long in a main scanning direction. The plurality of inkjet heads 1 are secured by being arranged side by side along the sheet-P conveying direction. That is, the printer 101 is a line printer.

The bottom surface of each inkjet head 1 is a discharge surface 2*a* where a plurality of nozzles 8 (see FIG. 5) that discharge ink are formed. When a sheet P that is being conveyed passes right below the plurality of inkjet heads 1, the inks having the respective colors are successively discharged from the nozzles 8 towards the top surface of the sheet P. This causes a predetermined color image to be formed on the top surface, that is, a print surface, of the sheet P.

Figure 2:
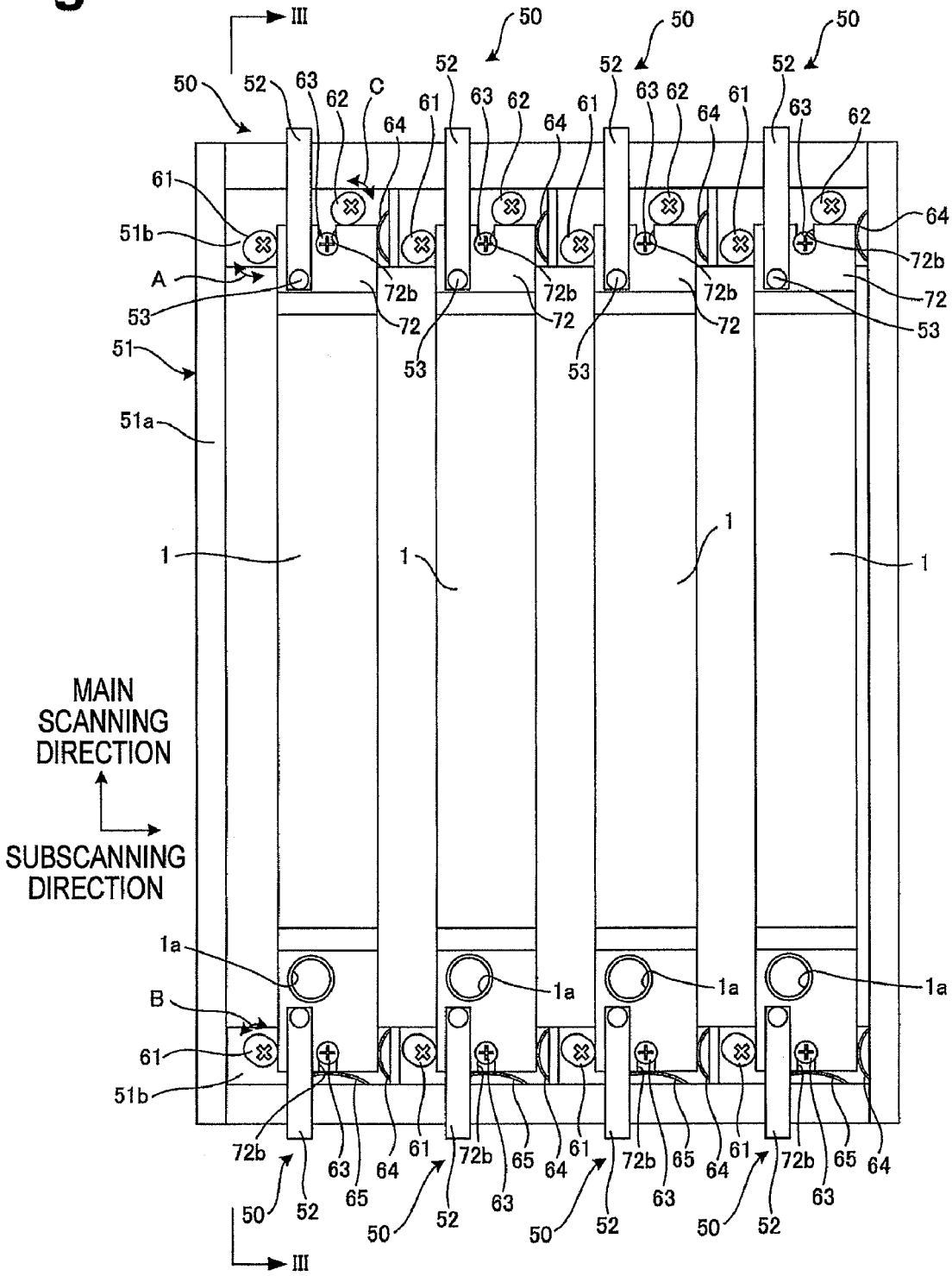
FIG. 2 is a plan view of the structure of the vicinity of inkjet heads shown in FIG. 1.
Figure 3:
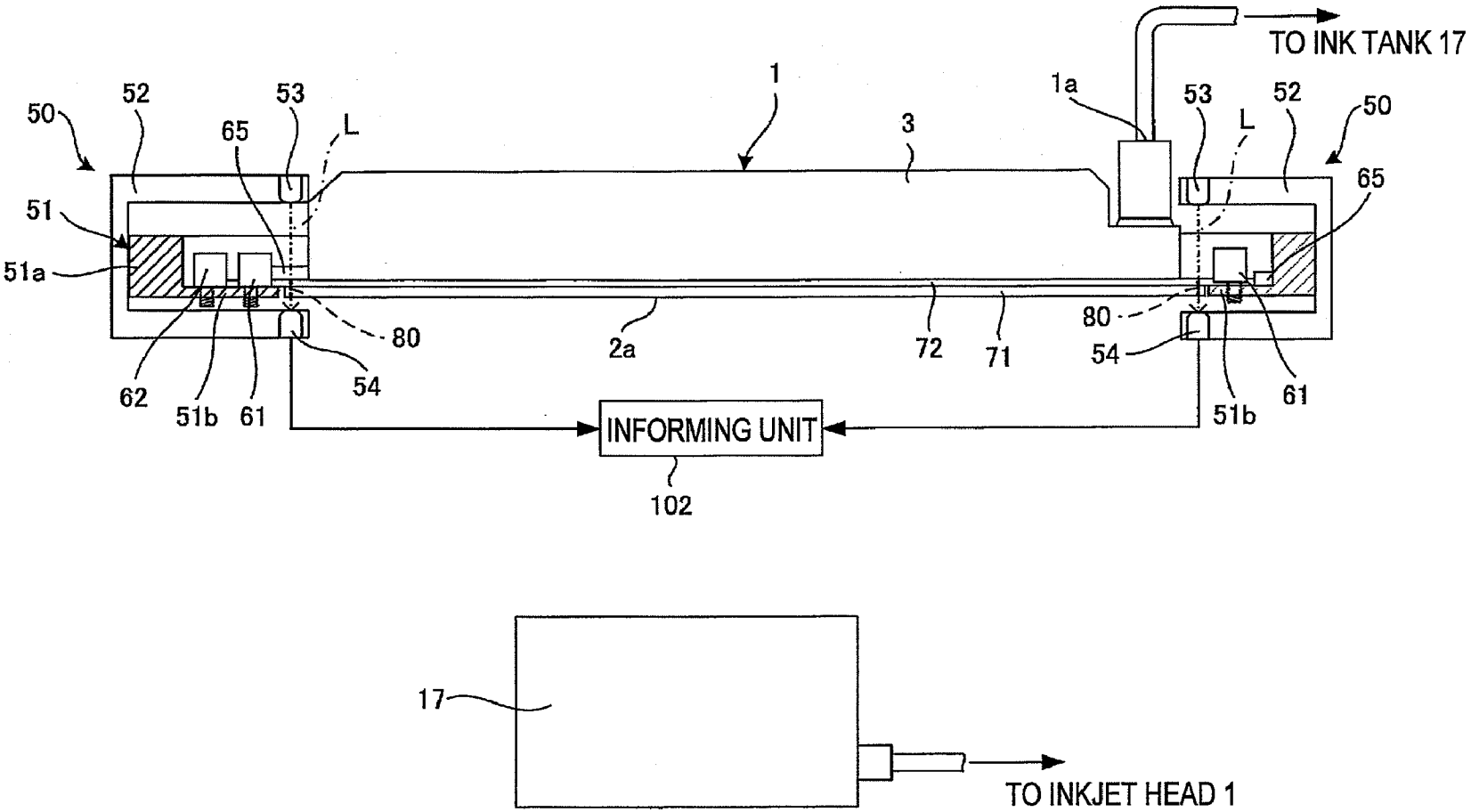
FIG. 3 is a side sectional view taken along line III-III in FIG. 2.

Referring to FIGS. 2 and 3, the plurality of, e.g., four, inkjet heads 1 are all secured to a head holder 51. The head holder 51 has side plates 51*a* and bottom plates 51*b*. The side plates 1*a* have rectangular flat shapes that surround the four sides of the plurality of, e.g., four, inkjet heads 1. The bottom plates 51*b* are disposed at the bottom portions of the side plates 51*a*. The bottom plates 51 extend in the subscanning direction, and are disposed at respective end portions of the side plates 51*a* in the main scanning direction.

Each inkjet head 1 includes a head body 71 and a reservoir plate 72, secured to the top surface of the head body 71. The lower surface of each head body 71 is the discharge surface 2*a*. Ink flow paths are formed in the head bodies 71 and the reservoir plates 72. Head covers 3 are secured to the top surfaces of the reservoir plates 72. Ink supply ports 1*a* for supplying ink to the head bodies 71 and the reservoir plates 72 are disposed in the upper surfaces of the head covers 3. The ink supply ports 1*a* are connected to the ink tanks 17, disposed in the ink tank unit 101*c*, through a tube. Ink from the ink supply ports 1*a* is supplied to the head bodies 71 through the reservoir plates 72.

Cutaway portions 72*b* are formed in respective ends of the reservoir plates 72 in a longitudinal direction thereof. By screws 63 passing through the cutaway portions 72*b* from the upper sides thereof, the reservoir plates 72 are secured to the top surfaces of the bottom plates 51*b* of the head holder 51. The cutaway portions 72*b* are formed to a size that does not allow the heads of the screws 62 to pass therethrough, that is slightly larger than the size of underhead portions of the screws 62, and that allows a slightly excessive space to be formed between the inner surfaces of the cutaway portions 72*b* and the underhead portions of the screws 63. By this, when the screws 63 are sufficiently tightened, the reservoir plates 72 can be firmly interposed and secured between the heads of the screws 63 and the bottom plates 51*b*; and when the screws 63 are loosened, the reservoir plates 72 can be slightly moved in either the main scanning direction or the subscanning direction.

Eccentric screws 61 and 62 are set close to respective ends in the longitudinal direction of each inkjet head 1. The head of each of the eccentric screws 61 and 62 has a flat shape formed by extending a circle in one direction. The eccentric screws 61 and 62 are secured to the top surface of the bottom plates 51*b* of the head holder 51, and are disposed such that the heads of the eccentric screws 61 and 62 contact the edges of the reservoir plates 72. In FIG. 2, the eccentric screws 61 contact the reservoir plates 72 from the left side (i.e., from the subscanning direction), and the eccentric screws 62 contact the reservoir plates 72 from the upper side (i.e., from the main scanning direction).

Plate springs 64 contact edges of the reservoir plates 72 opposite to the eccentric screws 61 in the subscanning direction. The plate springs 64 oppose the eccentric screws 61 in the subscanning direction, and urge the reservoir plates 72 towards the eccentric screws 61. The eccentric screws 61 contact the reservoir plates 72, urged by the plate springs 64, in a direction opposite to the urging direction, thereby maintaining the positions of the reservoir plates 72 in the subscanning direction. When, in this state, the eccentric screws 61 are rotated in directions A or directions B in FIG. 2, the positions at which the eccentric screws 61 contact the reservoir plates 72 change. This makes it possible for the positions of both ends in the longitudinal direction of the reservoir plates 72 to be continuously changed in the subscanning direction.

Plate springs 65 contact edges of the reservoir plates 72 opposite to the eccentric screws 62 in the main scanning direction. The plate springs 65 oppose the eccentric screws 62 in the main scanning direction, and urge the reservoir plates 72 towards the eccentric screws 62. The eccentric screws 62 contact the reservoir plates 72, urged by the plate springs 65, in a direction opposite to the urging direction, thereby maintaining the positions of the reservoir plates 72 in the subscanning direction. When, in this state, the eccentric screws 62 are rotated in directions C in FIG. 2, the positions at which the eccentric screws 62 contact the reservoir plates 72 change. This makes it possible for the positions of the reservoir plates 72 to be continuously changed in the main scanning direction.

Optical sensors 50 that detect the positions of the inkjet heads 1 in the horizontal direction are provided at the inkjet printer 101. The optical sensors 50 are set at respective ends in the longitudinal direction of each inkjet head 1. Each optical sensor 50 includes a light emitting section 53 that emits laser light, a light receiving section 54 that receives the laser light from the light emitting section 53, and an arm 52 that secures the light emitting section 53 and the light receiving section 54 to the head holder 51.

Referring to FIG. 3, the light emitting sections 53 are disposed at positions that allow laser light L to be emitted from the upper side to the lower side of each reservoir plate 72. The light receiving sections 54 are disposed at positions below the corresponding inkjet head 1 that allow them to receive the laser light L from the light emitting sections 53. At predetermined positions in the horizontal direction of the reverser plates 72 and the head bodies 71, passage holes 80 are formed along the direction of emission of the laser light L. The passage holes 80 extend from the upper surface of the reservoir plates 72 to the lower surface of the head bodies 71.

In the optical sensors 50, when the light receiving sections 54 detect the laser light L from the light emitting sections 53, the light receiving sections 54 output signals indicating the detections of the laser light L to the informing units 102. On the basis of the signals from the optical sensors 50, for example, a lamp is turned on for every optical sensor 50 to inform, for example, a user that the light receiving sections 54 have detected the laser light from the light emitting sections 53.

Therefore, when the inkjet heads 1 are disposed with respect to the head holder 51 such that the laser light L passes right through the passage holes 80 and reaches the light receiving sections 54, the informing units 102 inform, for example, a user that the laser light L is detected. In contrast, when the inkjet heads 1 are disposed with respect to the head holder 51 such that the laser light L is displaced from the passage holes 80, is blocked by the laser plates 72, and does not reach the light receiving sections 54, the informing units 102 inform, for example, a user that the laser light L is not detected. By this, for example, the user can know whether or not the inkjet heads 1 are disposed at predetermined positions with respect to the head holder 51.

By virtue of the above-described structure, when the inkjet printer 101 is assembled or any inkjet head 1 is replaced, it is possible to precisely position the inkjet heads 1 in the horizontal direction with respect to the head holder 51. For example, when the inkjet heads 1 are mounted to the head holder 51, first, the cutaway portions 72*b* of the inkjet heads 1 are disposed at positions where they are secured with the screws 63. Using the screws 63, the reservoir plates 72 are secured to the bottom plates 51*b* of the head holder 51. At this time, the screws 63 are not tightened very much, thereby allowing the reservoir plates 72 to move horizontally.

Next, by rotating the eccentric screws 62 shown in FIG. 2 in the directions A or the directions B, both ends in the longitudinal direction of each inkjet head 1 are moved leftward and rightward in FIG. 2. By rotating the eccentric screws 62 shown in FIG. 2 in the directions C, the inkjet heads 1 are moved in the longitudinal direction thereof. Here, since the plate springs 64 and 65 urge the reservoir plates 72 towards the eccentric screws 61 and 62, respectively, the inkjet heads 1 can be continuously displaced while the eccentric screws 61 and 62 contact the reservoir plates 72.

The positions of the inkjet heads 1 in the horizontal direction are adjusted such that the informing units 102 are in a state that allows them to inform, for example, a user that the laser light L is detected by all of the optical sensors 50. This makes it possible for the inkjet heads 1 to be disposed at predetermined positions with respect to the head holder 51. When all of the inkjet heads 1 are disposed at the predetermined positions with respect to the head holder 51, the screws 63 are sufficiently tightened, to completely secure the inkjet heads 1 to the head holder 51. When the inkjet heads 1 are secured to the head holder 51 at their predetermined positions, the inkjet heads 1 are aligned in the longitudinal direction (i.e., main scanning direction), that is, in a direction orthogonal to the direction of conveyance by the conveying belt 96. In addition, the passage holes 80 are formed at predetermined positions with respect to the nozzles 8 in the discharge surfaces 2*a*. Therefore, when the positions of the inkjet heads 1 are determined, the nozzles 8 of the respective inkjet heads 1 are arranged on an imaginary straight line along the conveying direction, such that they are disposed at positions where there is no color misregistration between the inkjet heads 1 when images are formed.

Figure 4:
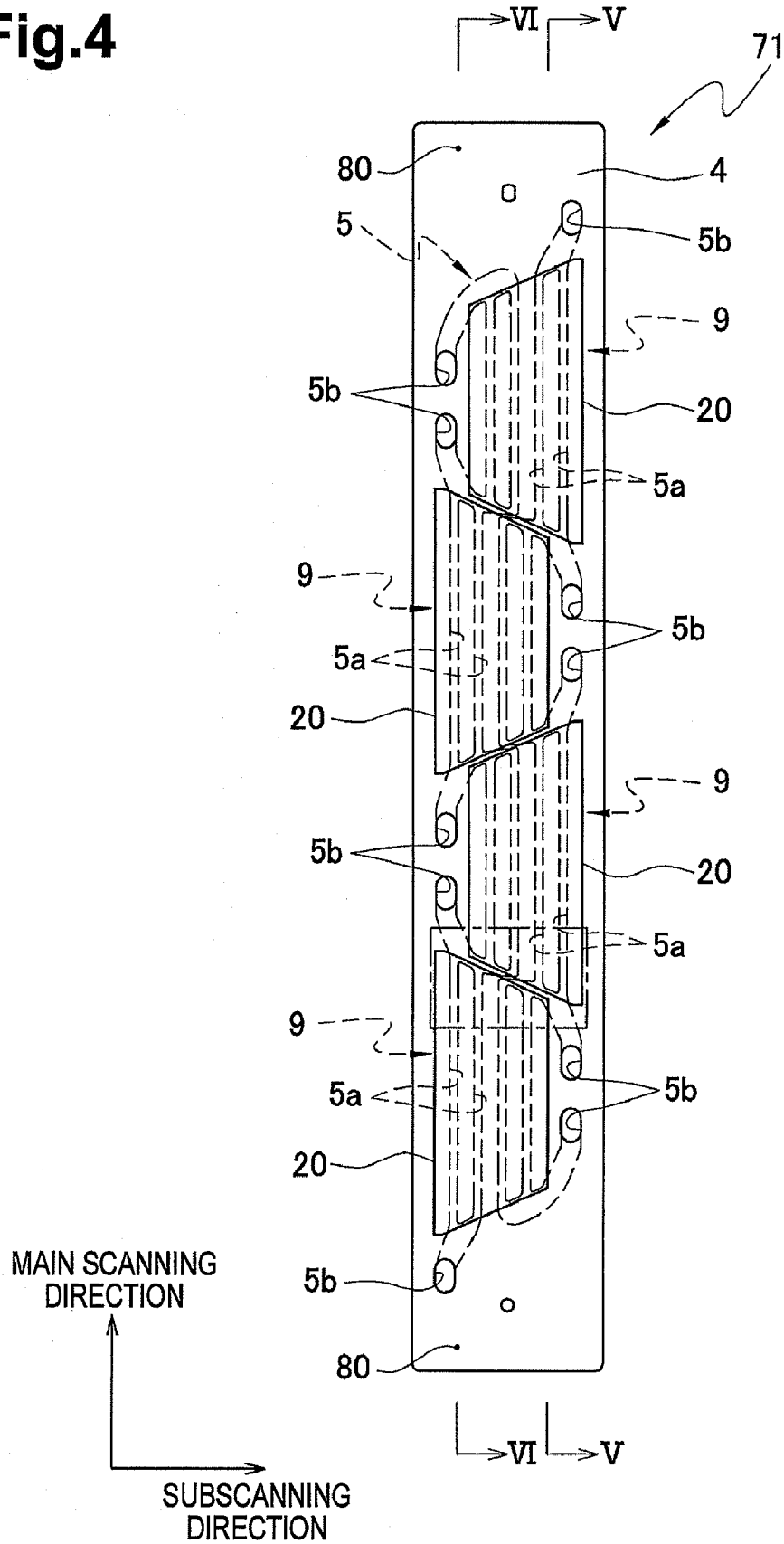
FIG. 4 is a plan view of a head body shown in FIG. 3.

Referring to FIG. 4, each head body 71 includes a flow path unit 4, in which an ink flow path is formed, and actuator units 20 that apply discharge energy to ink in the ink flow path of the flow path unit 4. Each flow path unit 4 has a rectangular flat shape that is long in the main scanning direction. The passage holes 80 that pass the laser light from the optical sensors 50 therethrough open near the respective ends in the longitudinal direction of the upper surfaces of the flow path units 4. In each flow path unit 4, pressure chamber groups 9, in which many pressure chambers 10 are distributed within a trapezoidal range in plan view, are formed in the corresponding flow path unit 4.

The plurality of, e.g., four, actuator units 20 having a trapezoidal shape are adhered to the top surface of the corresponding flow path unit 4 in two rows and in a staggered arrangement in correspondence with the disposition of the pressure chamber groups 9. In the lower surface of each flow path unit 4, an area opposing an adhesion area of each actuator unit 20 is an ink discharge area in which the ports of the nozzles 8 are distributed. Each ink discharge area has a trapezoidal shape similarly to each actuator unit 20.

Manifold flow paths 5, which are formed consecutively with ink supply ports 5*b*, and sub-manifold flow paths 5*a*, which branch from the manifold flow paths 5, are formed in each flow path unit 4. Ink from the reservoir plates 72 is supplied to the ink supply ports 5*b*. In each area between two actuator units 20, one common manifold flow path 5 is provided between the adjacent actuator units 20, and the manifold flow paths 5*a* branch from respective sides of the manifold flow path 5 in the longitudinal direction.

Figure 5:
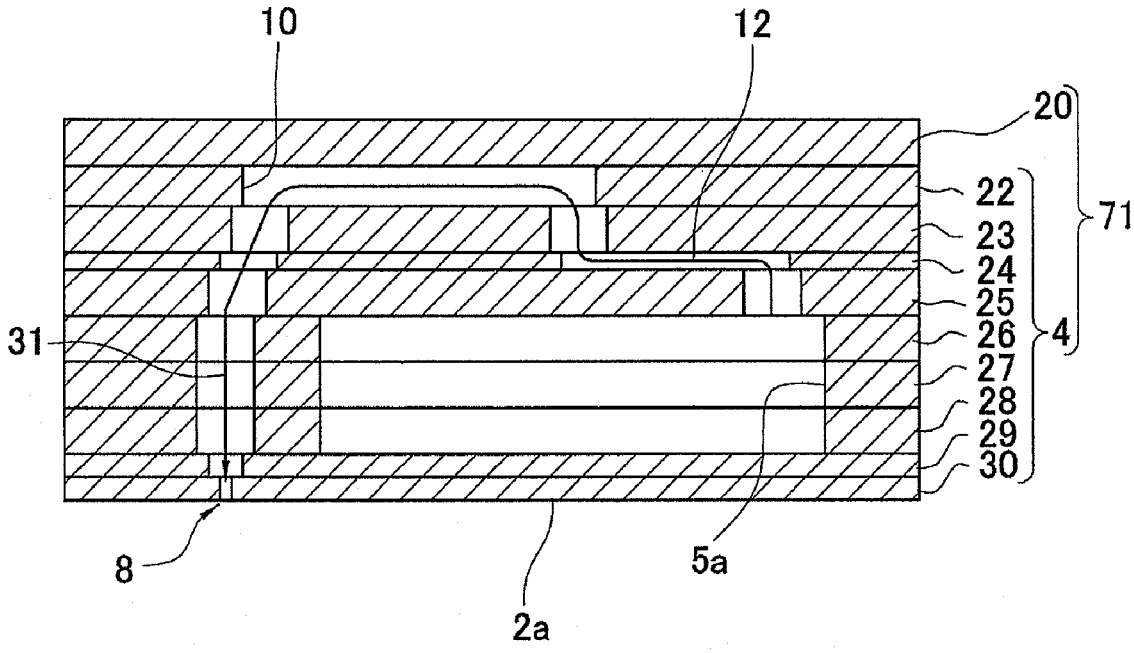
FIG. 5 is a partial enlarged view of a sectional view taken along line V-V in FIG. 4.

Referring to FIG. 5, each flow path unit 4 includes a plurality of, e.g., nine, metallic plates 22 to 30 formed of, for example, stainless steel. The plates 22 to 30 are rectangular flat members that are long in the main scanning direction. A plurality of through holes or grooves are formed in the plates 22 to 30 by etching or pressing. The through holes and grooves are connected to each other by aligning the plates 22 to 30 with each other and stacking them upon each other, such that the sub-manifold flow paths 5*a* and many individual ink flow paths 31, which extend from the exits of the sub-manifold flow paths 5*a* to the nozzles 8 through the pressure chambers 10, are formed.

The actuator units 20 are secured to the top surface of each flow path unit 4. Each actuator unit 20 includes a plurality of actuators provided so as to oppose the pressure chambers 10, and selectively applies discharge energy to ink in the pressure chambers 10. Each inkjet head 1 is provided with a substrate and a driver integrated circuit (IC), both of which are not shown. When a control command is transmitted to each inkjet head 1 from the controlling unit 100, drive signals are supplied to the actuator units 20 through the substrates and the driver ICs. In accordance with such drive signals, the discharge energy is applied to the ink in the pressure chambers 10. This causes a predetermined amount of ink to be discharged from the nozzles 8 at a predetermined timing.

Figure 6:
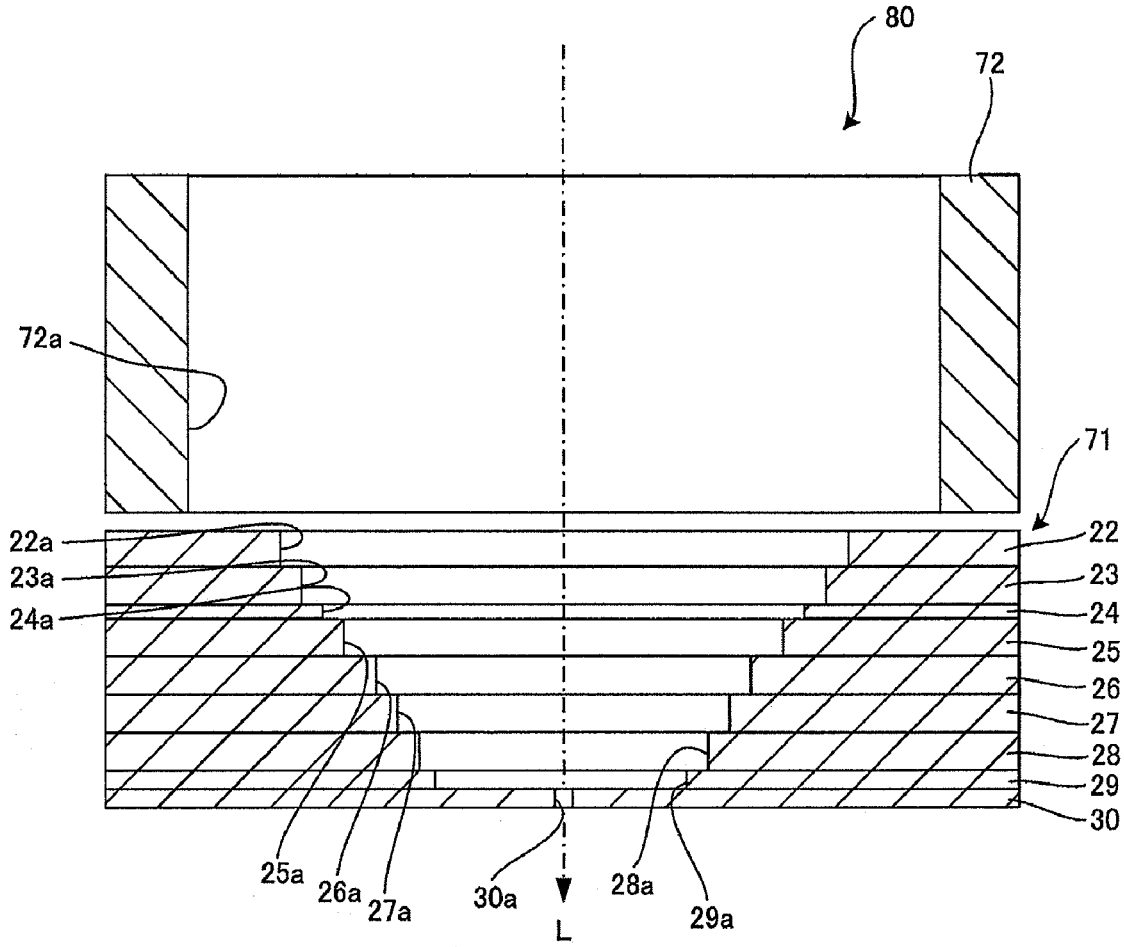
FIG. 6 is an enlarged view of the vicinity of a passage hole in a cross section taken along line VI-VI in FIG. 4.

Referring to FIG. 6, the passage holes 80 are formed by through holes 72*a* formed in the plates 72 and through holes 22*a* to 30*a* formed in the plates 22 to 30. These through holes have annular flat shapes, and are concentrically disposed. The lower down the positions of the through holes, the smaller are their diameters in plan view. That is, the diameter of each topmost through hole 72*a* is the largest, and the lower down the positions of the through holes, the smaller their diameters, such that the diameter of each bottommost through hole 30*a* is the smallest. By such a structure, when the passage holes 80 are viewed from above the reservoir plates 72, the through holes 30*a* are easily viewed through the through holes 72*a* and the through holes 22*a* to 29*a*. In FIG. 6, the cross section of the head body 71 as well as the cross section of the reservoir plate 72 are shown. The cross section of the reservoir plate 72 is one along an extension plane of a section taken along line VI-VI in FIG. 4.

The through holes 30*a* are formed with a size that is substantially the same as a beam diameter of the laser light L passing through the passage holes 80. By this, since the optical sensors 50 can no longer detect the laser light when the positions where the laser light passes are displaced even slightly, the precision with which the inkjet heads 1 are positioned using the optical sensors 50 is increased.

The beam diameter of the laser light varies depending upon how it is defined. For example, in defining the beam diameter of the laser light, a 1/e^2 method, an FWHM method, a D4σ method, or a D86 method is used. In the specification, the essence of the phrase "a size that is substantially the same as a beam diameter of the laser light" is that a difference in the beam diameter due to a difference in definition is included. This is because, even if differences in the diameters of the through holes 30*a* occur due to a difference in the definition of the beam diameter, if the differences in the diameters occur by amounts resulting from the difference in the definition of the beam diameter, the differences in the diameters do not affect so much the positioning precision of the inkjet heads 1. However, when the diameters of the through holes 30*a* are greater than or equal to 2 to 3 times the beam diameter defined by any of these definitions, even if the center of intensity of the laser light L and the center of each through hole 30*a* are slightly separated from each other, the optical sensors 50 are capable of detecting the laser light L. This reduces the positioning precision of the inkjet heads, which is not desirable.

The size and shape of the through holes 30*a* are the same as those of the nozzles 8. The through holes 30*a* are disposed so as to be situated at predetermined positions with respect to the nozzles 8 in the horizontal direction. This positional relationship is such that, when the inkjet heads 1 are positioned at locations that allow the optical sensors 50 to detect the laser light L passing through the through holes 30*a*, the inkjet heads 1 can be precisely positioned with respect to the head holder 51.

According to the above-described embodiment, when the laser light from any light emitting section 53 is detected by the light receiving section 54, the corresponding optical sensor 50 transmits a signal indicating that this detection has been made to the corresponding informing unit 102. Then, the informing unit 102 informs, for example, a user that the laser light is detected by the optical sensor 50. Therefore, on the basis of information of the informing unit 102, the user can adjust the position of the inkjet head 1 when the inkjet printer 101 is used, such that the user can, for example, mount the inkjet head 1.

Since the diameter of the through hole 30*a* that is smallest in the passage hole 80 of the laser light is substantially equal to the beam diameter of the laser light, the inkjet head 1 can be positioned with high precision.

The through holes 30*a* are formed in the nozzle plates 30 where the nozzles 8 are formed. This makes it possible to directly position and form the through holes 30*a* with respect to the nozzles 8. For example, when the nozzles 8 are formed in the nozzle plates 30 by a pressing operation, the through holes 30*a* may also be formed simultaneously therewith. More specifically, for a punch used in the pressing operation, pins for forming the through holes 30*a* are provided along with pins for forming the nozzles 8. Therefore, when the positions of the nozzles 8 and the through holes 30*a* are precisely adjusted with respect to each other, the nozzles 8 and the through holes 30*a* can be formed at the same time in the nozzle plates 30.

The through holes 22*a* to 30*a* and the through holes 72*a*, constituting the passage holes 80 for the laser light, are formed in the plates 22 to 30 and the plates 72. Therefore, when the plates 22 to 30 are stacked upon each other, the plates can be positioned with respect to each other using the through holes thereof.

Figure 7:
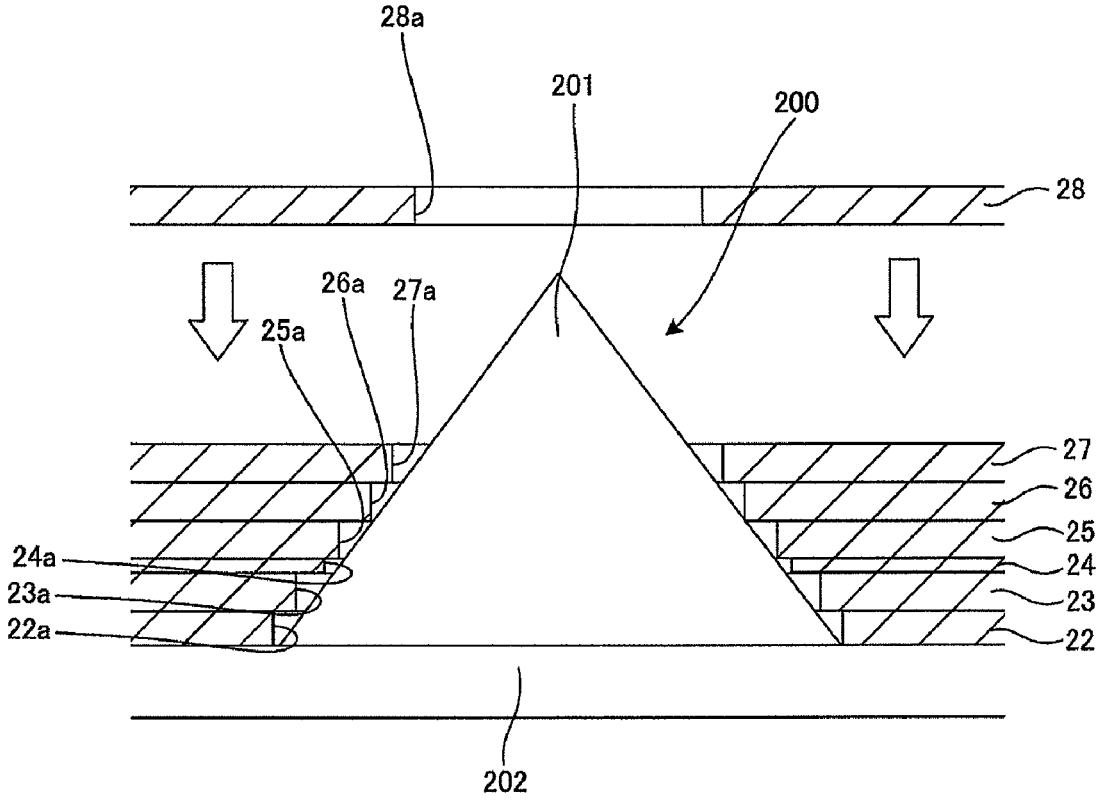
FIG. 7 shows a process of stacking upon each other plates used to form a flow-path unit shown in FIG. 5.
Figure 8:
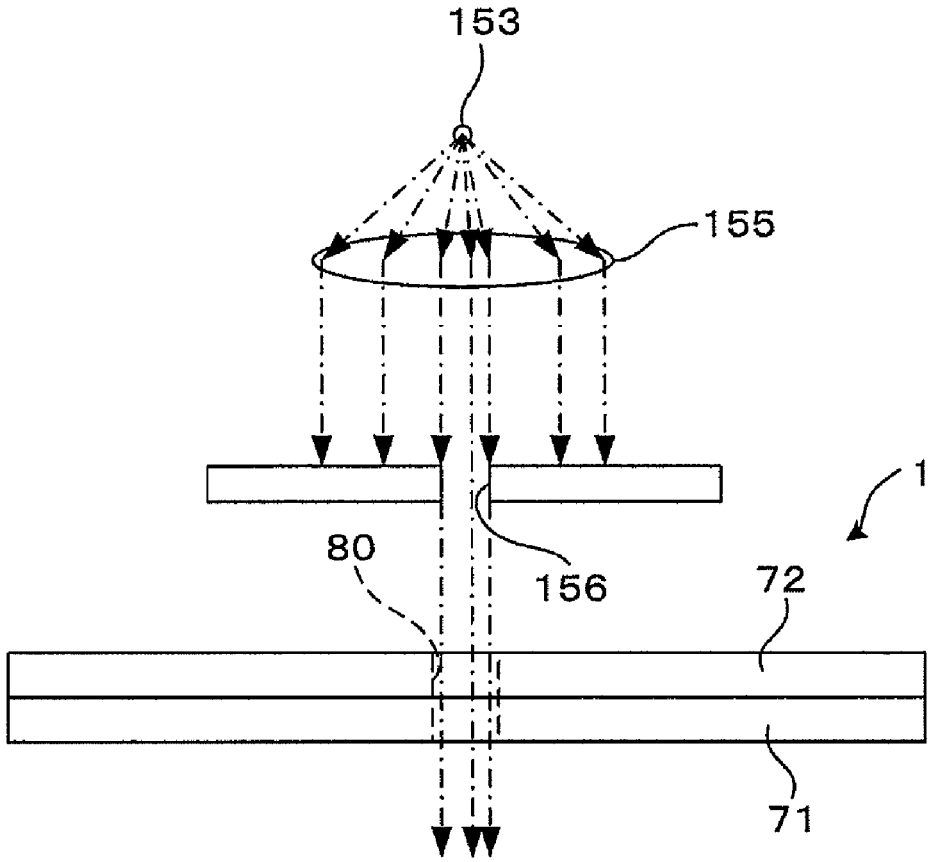
FIG. 8 shows a modification related to an optical sensor.

Referring to FIG. 7, an example of positioning the plates with respect to each other using the through holes thereof will be described. In this positioning, a jig 200 provided with a projection 201 on the top surface of a base 202 is used. The projection 201 is formed such that it has an outer surface whose shape and size are roughly the same as those of the inner surface of the passage hole 80. Therefore, by successively stacking the plate 22 and the other plates while placing the through hole 22*a* and the other through holes onto the projection 201, these plates can be stacked upon each other while precisely positioning them with respect to each other. For example, a thermosetting adhesive is applied adhesion surfaces of the plate 22 and the other plates, and the plate 22 and the other plates are stacked upon each other using the jig 200. Thereafter, by heating the entire stacked-plate structure, the plates are joined to each other. This makes it possible to precisely position the plates with respect to each other and join them with each other. Instead of positioning the plates with respect to each other using the projection 201, the plates may be positioned with respect to each other while viewing the through holes 22*a* to 30*a* using a microscope.

Modification

Although an embodiment of the present invention is described above, the present invention is not limited to the above-described embodiment, so that various modifications may be made.

For example, in the above-described embodiment, the optical sensors 50 output detection results on the basis of whether or not the laser light reaches the light receiving sections 54. However, the positions of the inkjet heads 1 may be more precisely detected by detecting the intensity of the light received by the light receiving sections 54 in stages, and outputting detection results by the optical sensors 50.

Although the light emitting sections 53 and the light receiving sections 54 are both secured to the head holder 51, either of the light emitting sections 53 and the light receiving sections 54 may be secured to the respective inkjet heads 1. For example, the inkjet printer 101 may be formed such that the positions of the inkjet heads 1 are detected by causing the laser light from the light emitting sections 53, secured to the inkjet heads 1, to be received by the light receiving sections 54, directly secured to the housing 101*a* secured to the head holder 51.

The light emitting sections 53 and the light receiving sections 54 may both be secured to the inkjet heads 1. For example, when the passage holes for the laser light are formed in the head holder 51 and the inkjet heads 1 are mounted to the head holder 51, the light emitting sections 53 and the light receiving sections 54, secured to the inkjet heads 1, are disposed on respective sides of the passage holes of the head holder 51. In addition, the laser light from the light emitting sections 53 may pass through the passage holes of the head holder 51 and reach the light receiving sections 54 when the positions of the inkjet heads 1 are finely adjusted with, for example, the eccentric screws 61 and the inkjet heads are disposed at the predetermined positions with respect to the head holder 51.

Although, in the above-described embodiment, sections that emit laser light are used as the light emitting sections 53, they may also be sections that emit light other than laser light. For example, referring to FIG. 8, point light sources 153 that radially emit light may be used as the light emitting sections. In this example, each point light source 153 is disposed at a focus of a convex lens 155 disposed between the point light source 153 and the corresponding inkjet head 1. A slit 156 is provided between the convex lens 155 and the inkjet head 1. As shown by an alternate long and short dash line in FIG. 8, light from the point light source 153 becomes parallel light by the convex lens 155, and is narrowed by the slit 156. When the inkjet head 1 and the corresponding point light source 153 are at predetermined positions with respect to each other, the light narrowed by the slit 156 passes through the passage hole 80. By detecting the light that has passed through the passage hole 80, it is possible to detect that the inkjet head 1 and the point light source 153 are at the predetermined positions with respect to each other.

In addition, the positions of the inkjet heads 1 may be detected by causing the laser light from the light emitting sections 53 to be reflected by the inkjet heads 1 and by detecting the reflected light by the light receiving sections 54.

As described above, if the inkjet printer 101 is formed such that the intensity of the light received by the light receiving sections change in accordance with the positional relationship between the inkjet heads 1 and the head holder 51, any type of optical system may be used.

In the above-described embodiment, the further up the through holes 72*a* and 22*a* to 30*a* are disposed, the larger their diameters. However, they need not be formed in this way as long as the through holes 72*a* and 22*a* to 29*a* are larger than the through holes 30*a* so that the through holes 30*a* can be viewed.

In the above-described embodiment, a user is informed of the positional relationship between the inkjet heads 1 and the head holder 51 by causing the informing unit 102 to inform the user of the detection of the laser light at each optical sensor 50. However, as long as means for outputting detection 50 results of the optical sensors is used, the means may have a structure other than that mentioned above. For example, the means may output a signal of the aforementioned positional relationship to the controlling unit 100 on the basis of the detection results of the optical sensors 50. In this case, the controlling unit 100 may be formed such that information of the positions of the inkjet heads 1 is displayed on, for example, a display on the basis of the signal of the aforementioned positional relationship. In addition, an interface that outputs the detection results of the optical sensors 50 to an external device may be provided.

Figure 9:
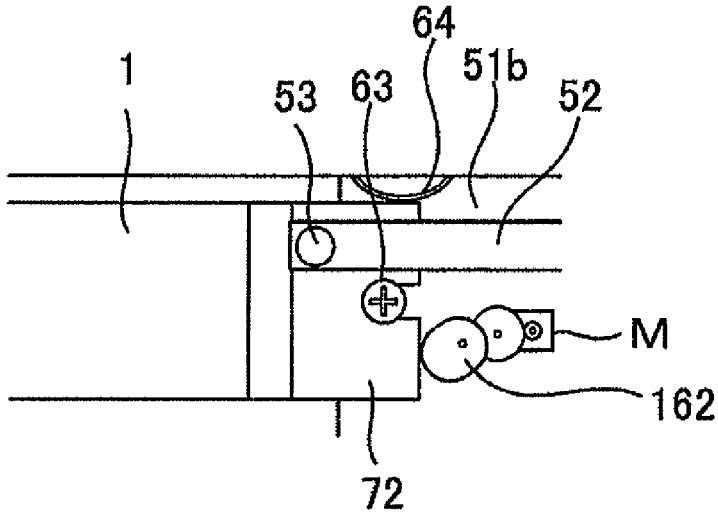
FIG. 9 shows a modification of a head position adjusting mechanism.

In the above-described embodiment, a user adjusts the positions of the inkjet heads 1 by using a combination of the plate springs 64 and 65 and the eccentric screws 61 and 62. Here, the adjustments using the eccentric screws 61 and 62 may be automatically performed. For example, the structure shown in FIG. 9 is used. Although here, for simplifying the description, a portion of the structure that adjusts the positions of the inkjet heads 1 in the longitudinal direction is only shown, adjustments in other directions are also similarly carried out. In this example, an eccentric cam 162 is used instead of the eccentric screw 62. The other structural features are the same as those of the above-described embodiment. The eccentric cam 162 is connected to an adjusting motor M through a gear. The informing unit 102 is provided with a driving button that instructs driving of the adjusting motor M. A user adjusts the position of each inkjet head 1 by operating the driving button. This makes it possible to adjust the inkjet printer 101 from outside the inkjet printer 101, thereby facilitating the adjustment.

Although, in the above-described embodiment, the present invention is applied to inkjet heads that discharge ink from nozzles, the present invention is not only applicable to inkjet heads. For example, the present invention may be applied to liquid droplet discharge heads for forming fine wiring patterns on a substrate by discharging conductive paste, or for forming a high-definition display by discharging organic light emitting material on a substrate, or for forming very small electronic devices, such as optical waveguides, by discharging optical resin on a substrate.

What is claimed is:

1. A recording device comprising:

a recording head comprising a discharge port that is configured to discharge a liquid droplet;

a head supporting member that is configured to support the recording head;

a securing member that is configured to secure the recording head to the head supporting member such that a positional relationship between the head supporting member and the recording head is changeable in a direction intersecting a liquid droplet discharging direction;

a light emitter that is configured to emit a light;

a light receiver that is configured to receive the light from the light emitter;

a position detector that is configured to detect the positional relationship on the basis of an intensity of the light received by the light receiver; and an outputting unit that is configured to output a signal of the positional relationship detected by the position detector, wherein the light emitter and the light receiver are positioned such that the intensity of the light received by the light receiver is changed in accordance with the positional relationship, and wherein the recording head comprises a passage hole configured to allow the light from the light emitter to pass therethrough.

2. The recording device according to claim 1, wherein when the positional relationship is within a predetermined range, the light from the light emitter passes through the passage hole and reaches the light receiver.

3. The recording device according to claim 2, wherein the light emitter is configured to emit a laser light, and wherein the passage hole is formed such that a beam diameter of the laser light and a smallest diameter of the passage hole in a direction orthogonal to a direction of passage of the laser light from the light emitter are substantially equal to each other.

4. The recording device according to claim 1, wherein the recording head comprises a flat member at whose surface the discharge port opens, and wherein the passage hole is formed such that the flat member and the discharge port are in a predetermined positional relationship.

5. The recording device according to claim 4, wherein the passage hole comprises a portion formed from an external surface of the recording head to the flat member along the direction of passage of the light from the light emitter, and a portion formed at the flat member.

6. The recording device according to claim 5, wherein the diameter of the portion formed from the external surface of the recording head to the flat member is greater than the diameter of the portion formed at the flat member.

7. The recording device according to claim 6, wherein the recording head comprises a stacked body in which a plurality of the flat members at which a plurality of the discharge ports open are stacked upon each other.

8. The recording device according to claim 7, wherein the passage hole comprises a plurality of through holes formed in the plurality of the flat members.

9. The recording device according to claim 8, wherein the closer the through holes are to the light emitter, the larger the diameters of the through holes.

10. A method of manufacturing the recording device according to claim 9, the method comprising the steps of:

positioning the plurality of the flat members using the plurality of the through holes such that the plurality of the through holes oppose each other in a direction in which the flat members are stacked upon each other; and joining the plurality of the flat members to each other after positioning the plurality of the flat members with respect to each other.

11. The recording device according to claim 1, wherein the securing member comprises an urging member that is configured to urge the recording head in one direction intersecting the liquid droplet discharging direction.

12. The recording device according to claim 11, wherein the securing member further comprises a fastener that is configured to maintain a position of the recording head in the one direction.

13. The recording device according to claim 12, wherein the fastener is configured to be displaceable such that the position of the recording head that is maintained changes continuously in the one direction.

14. The recording device according to claim 13, wherein the fastener is an eccentric screw whose screw head is decentered in the direction intersecting the liquid droplet discharging direction.

15. The recording device according to claim 14, wherein the position of the recording head is maintained by contacting the screw head with the recording head.

16. A method of positioning the recording head in the recording device according to claim 1, the method comprising the step of:

adjusting the positional relationship between the head supporting member and the recording head in the direction intersecting the liquid droplet discharging direction on the basis of an output content of the outputting unit.

17. A recording device comprising:

a recording head comprising a discharge port that is configured to discharge a liquid droplet;

a head supporting member that is configured to support the recording head;

a securing member that is configured to secure the recording head to the head supporting member such that a positional relationship between the head supporting member and the recording head is changeable in a direction intersecting a liquid droplet discharging direction;

a light emitter that is configured to emit a light;

a light receiver that is configured to receive the light from the light emitter;

a position detector that is configured to detect the positional relationship on the basis of an intensity of the light received by the light receiver; and an outputting unit that is configured to output a signal of the positional relationship detected by the position detector, wherein the recording head comprises a passage hole configured to allow the light from the light emitter to pass therethrough.

* * * * *